US008712079B2

(12) United States Patent
Kim et al.

(10) Patent No.: US 8,712,079 B2
(45) Date of Patent: Apr. 29, 2014

(54) PIEZOELECTRIC SPEAKER AND METHOD OF MANUFACTURING THE SAME

(75) Inventors: Hye Jin Kim, Daejeon (KR); Sung Q Lee, Daejeon (KR); Min Cheol Shin, Daejeon (KR); Kang Ho Park, Daejeon (KR); Jong Dae Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 988 days.

(21) Appl. No.: 12/507,364

(22) Filed: Jul. 22, 2009

(65) Prior Publication Data

US 2010/0158283 A1 Jun. 24, 2010

(30) Foreign Application Priority Data

Dec. 22, 2008 (KR) ..... 10-2008-0131660

(51) Int. Cl.
*H04R 25/00* (2006.01)
*H04R 1/20* (2006.01)

(52) U.S. Cl.
USPC ..... 381/190; 381/354

(58) Field of Classification Search
USPC ..... 381/190, 354; 29/25.35; 310/27, 312, 310/326, 327, 345, 348, 351
See application file for complete search history.

(56) References Cited

U.S. PATENT DOCUMENTS

| | | | | |
|---|---|---|---|---|
| 5,488,954 | A | 2/1996 | Sleva et al. | |
| 5,852,337 | A * | 12/1998 | Takeuchi et al. | 310/328 |
| 6,912,288 | B2 * | 6/2005 | Nakashima et al. | 381/190 |
| 2004/0256961 | A1 * | 12/2004 | Namba et al. | 310/365 |

FOREIGN PATENT DOCUMENTS

| | | | | |
|---|---|---|---|---|
| JP | 63190413 | A * | 8/1988 | H03H 9/17 |
| JP | 2004096225 | | 3/2004 | |
| JP | 2004-147319 | | 5/2004 | |
| JP | 2005-260623 | | 9/2005 | |
| KR | 1020060021224 | A | 3/2006 | |
| KR | 1020060127013 | A | 12/2006 | |
| KR | 1020070042756 | A | 4/2007 | |
| KR | 1020070072689 | A | 7/2007 | |
| KR | 1020080052230 | A | 6/2008 | |
| KR | 1020080072329 | A | 8/2008 | |

* cited by examiner

*Primary Examiner* — Matthew Eason

(57) ABSTRACT

A piezoelectric speaker and a method of manufacturing the same that can obtain a high sound pressure using a piezoelectric thin film are provided. The piezoelectric speaker includes a piezoelectric thin film, electrodes formed on an upper surface or upper and lower surfaces of the piezoelectric thin film, a damping material layer formed on the lower surface of the piezoelectric thin film, and a frame attached around at least one of the piezoelectric thin film and the damping material layer using an adhesive.

19 Claims, 11 Drawing Sheets

PIEZOELECTRIC SPEAKER AND METHOD OF MANUFACTURING THE SAME

CROSS-REFERENCE TO RELATED APPLICATION

This application claims priority to and the benefit of Korean Patent Application No. 10-2008-0131660, filed Dec. 22, 2008, the disclosure of which is incorporated herein by reference in its entirety.

BACKGROUND

The present invention relates to a piezoelectric speaker and a method of manufacturing the same. More specifically, the present invention relates to a piezoelectric speaker, in which a piezoelectric thin film serves as a diaphragm to obtain a high sound pressure in a low-frequency region, and a method of manufacturing the same.

DISCUSSION OF RELATED ART

An acoustic actuator generally refers to a speaker, a receiver, or the like. A piezoelectric speaker is thin, lightweight, and consumes little power compared to an existing voice coil motor (VCM) speaker. Thus, there is a growing tendency to employ piezoelectric speakers in portable electronic devices such as portable terminals and personal digital assistants (PDAs).

When manufactured, most piezoelectric speakers are equipped with a piezoelectric oscillator, or a piezoelectric disk attached to the upper surface of a metal oscillator made of brass, stainless steel, nickel alloy or the like. In the case of a film-type piezoelectric speaker such as a polyvinylidene fluoride (PVDF) film speaker, entire upper and lower surfaces of a piezoelectric film are coated with a conductor.

Such a piezoelectric speaker will be described below with reference to FIGS. 1 through 3.

FIG. 1 is a cross-sectional view illustrating a conventional piezoelectric speaker with a piezoelectric oscillator.

Referring to FIG. 1, the conventional piezoelectric speaker is configured so that a piezoelectric oscillator 130 is mounted on a predetermined region of the edge of a vibrating panel 100. The piezoelectric oscillator 130 has a simple structure in which a piezoelectric actuator 110, in which an elastic member 112 is attached to a piezoelectric member 111 having an electrode, is attached to small and large elastic members 120 for transmitting vibration. In this piezoelectric speaker, vibration generated by the piezoelectric actuator 110 is transmitted to the outside through the elastic members 120, the cross-section of which is smaller than that of the piezoelectric actuator 110. When transmitted using the piezoelectric oscillator 130, the vibration must be transmitted to the vibrating panel 100. For this reason, the piezoelectric speaker must be able to generate very strong piezoelectric vibration, and must be equipped with a diaphragm of a different size because the piezoelectric oscillator 130 itself does not function as the diaphragm. Moreover, the piezoelectric speaker may cause unnecessary resonance in the process of transmitting the vibration.

FIG. 2 is a cross-sectional view illustrating another conventional piezoelectric speaker.

Referring to FIG. 2, the other conventional piezoelectric speaker is manufactured by attaching a piezoelectric member 220 to the upper surface of a vibrating thin film 200 made of metal, particularly, alloy, using an adhesive 210 such as epoxy. Typically, the piezoelectric member 220 is attached to the upper surface of the vibrating thin film 200 having a thickness ranging from tens to hundreds of microns, and the lower surface of the vibrating thin film 200 is coated with polymer 230, thereby forming a thick membrane.

The thinner the vibrating thin film 200, the greater its flexibility, which increases output sound pressure and enables reproduction of low-frequency sound. Thus, the thick vibrating thin film 200, the polymer 230, and the piezoelectric member 220 attached to the uppermost portion are obstacles to high output sound pressure and low-frequency sound reproduction. Furthermore, the process of attaching the piezoelectric member 220 to the vibrating thin film 200 using the adhesive 210 is complicated and difficult. Further, in the case of the vibrating thin film 200 being made of metal, harsh sound is generated due to cold tone color and sharp peak-dip of the metal material.

FIG. 3 is a cross-sectional view illustrating a conventional film-type speaker with a piezoelectric film.

Referring to FIG. 3, the conventional film-type speaker is a piezoelectric flat speaker using a piezoelectric film such as a PVDF film, and is configured so that polymeric conductive films 301 are formed on opposite sides of the piezoelectric film 300 and electrodes 302 are formed along edges of the polymeric conductive films 301. The electrodes 302 further extend outwardly from the polymeric conductive films 301 and form terminals 303 that are supported by a reinforcing tape 304 additionally provided on one side thereof. However, in this film-type speaker using the piezoelectric film, since a piezoelectric coefficient of the piezoelectric material is not large, the area of the vibrating thin film must be very wide. As such, the film-type speaker is used for ordinary/large speakers, and is unsuitable for small portable electronic devices such as portable terminals.

In such conventional piezoelectric speakers, the vibrating thin film must be made thin or large in order to create sufficient sound pressure. Thus, it is difficult to reduce the size of the piezoelectric speaker, and sound can be easily distorted by twisting of the vibrating thin film when it is made very thin. Further, the piezoelectric speakers have great difficulty in reproducing low-frequency sound compared to the VCM speaker.

SUMMARY OF THE INVENTION

The present invention is directed to a piezoelectric speaker and a method of manufacturing the same that are capable of reducing sound distortion without a separate diaphragm and reinforcing output sound pressure in a low-frequency region.

One aspect of the present invention provides a piezoelectric speaker including: a piezoelectric thin film; electrodes formed on an upper surface or upper and lower surfaces of the piezoelectric thin film; a damping material layer formed on the lower surface of the piezoelectric thin film; and a frame attached around at least one of the piezoelectric thin film and the damping material layer using an adhesive.

Another aspect of the present invention provides a method of manufacturing a piezoelectric speaker including: forming electrodes on an upper surface or upper and lower surfaces of a piezoelectric thin film; forming a damping material layer on the lower surface of the piezoelectric thin film; and attaching a frame around at least one of the piezoelectric thin film and the damping material layer using an adhesive.

Still another aspect of the present invention provides a method of manufacturing a piezoelectric speaker including: forming a damping material layer on a silicon substrate; attaching a piezoelectric thin film, on which a first electrode is formed, to an upper surface of the damping material layer;

and attaching a frame around at least one of the piezoelectric thin film and the damping material layer using an adhesive.

According to the present invention, the piezoelectric thin film itself serves as a diaphragm, without a separate diaphragm, and the diaphragm is coated with the damping material layer. Thus, sound distortion can be reduced and high output sound pressure can be obtained even in a low-frequency region.

Further, the thin small frame is attached to the piezoelectric thin film coated with the damping material layer using a high-elasticity low-viscosity material so that sound distortion can be reduced. Also, the electrodes are asymmetrically formed on the upper and lower surfaces of the piezoelectric thin film, or engaging electrodes are formed on the upper surface of the piezoelectric thin film, and the piezoelectric thin film having the electrodes is formed to be very thin and have a simple structure. Thus, output sound pressure can be increased, reproduction of low-frequency sound can be improved, and manufacturing cost can be reduced due to a simplified manufacturing process and facilitation of mass production.

BRIEF DESCRIPTION OF THE DRAWINGS

The above and other objects, features and advantages of the present invention will become more apparent to those of ordinary skill in the art by describing in detail exemplary embodiments thereof with reference to the attached drawings, in which.

DETAILED DESCRIPTION OF EXEMPLARY EMBODIMENTS

The present invention will be described more fully hereinafter with reference to the accompanying drawings, in which exemplary embodiments of the invention are shown. This invention may, however, be embodied in different forms and should not be construed as limited to the exemplary embodiments set forth herein. It should be noted that the same reference numbers are used in the figures to denote the same elements. Further, known functions and components incorporated into the invention will not be described when deemed that such description may detract from the clarity and concision of the disclosure of the subject matter of the present invention.

Figure 1:
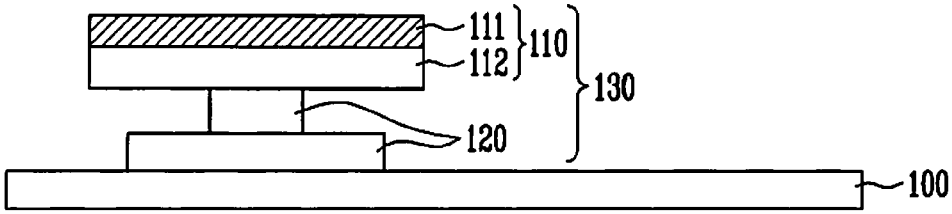
FIG. 1 (PRIOR ART)
FIG. 1 is a cross-sectional view illustrating a conventional piezoelectric speaker with a piezoelectric oscillator.
Figure 2:
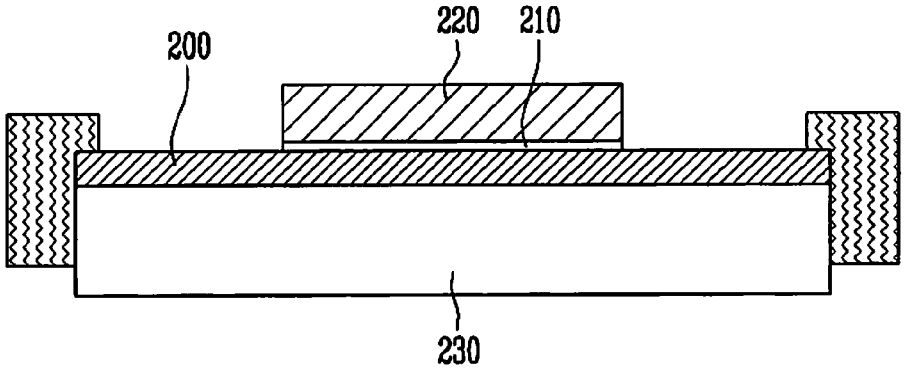
FIG. 2 (PRIOR ART)
FIG. 2 is a cross-sectional view illustrating another conventional piezoelectric speaker.
Figure 3:
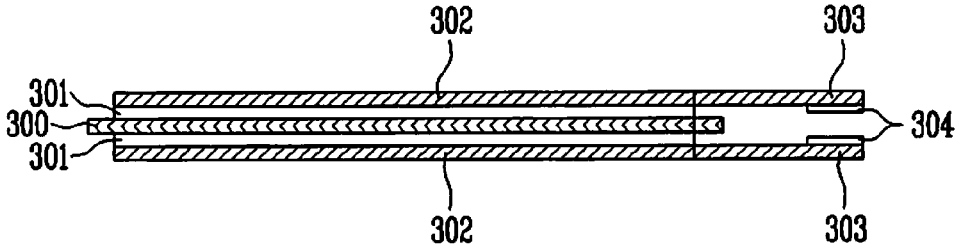
FIG. 3 (PRIOR ART)
FIG. 3 is a cross-sectional view illustrating a conventional film-type speaker with a piezoelectric film.
Figure 4:
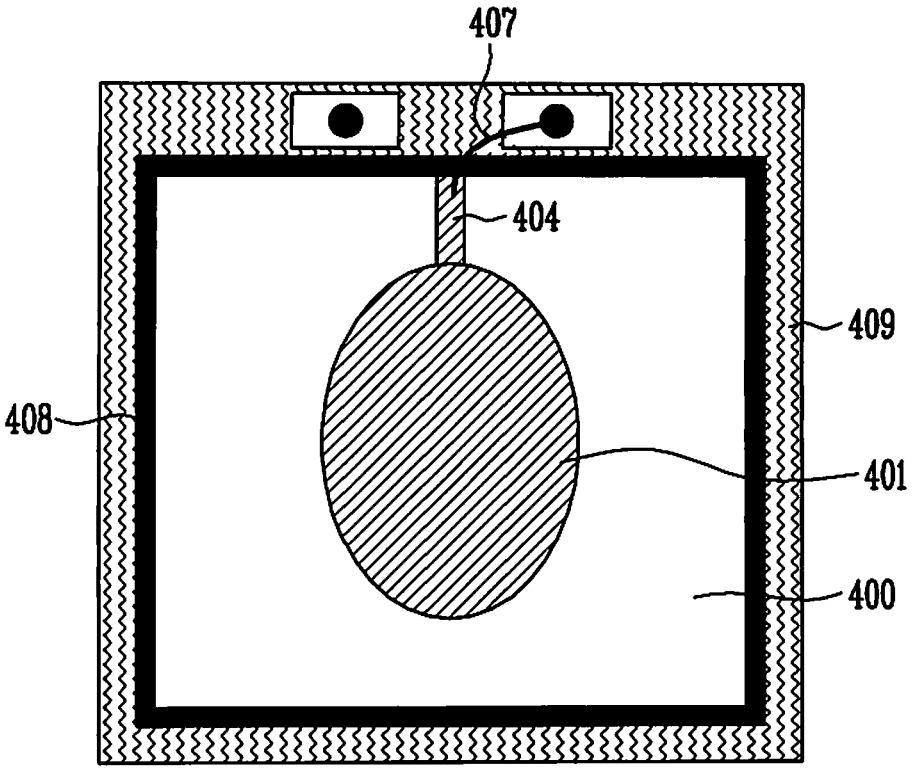
FIG. 4 is a plan view illustrating a piezoelectric speaker according to a first exemplary embodiment of the present invention.

FIG. 4 is a plan view illustrating a piezoelectric speaker according to a first exemplary embodiment of the present invention.

Referring to FIG. 4, the piezoelectric speaker includes a flat piezoelectric thin film 400, a first electrode 401 formed on a predetermined region of an upper surface of the piezoelectric thin film 400, a second electrode (not shown) formed on a predetermined region of a lower surface of the piezoelectric thin film 400, a frame 409 attached to the piezoelectric thin film 400 using an adhesive 408 so as to surround the piezoelectric thin film 400, and a signal wire 407 formed on a predetermined region of the frame 409 to apply voltage to the first electrode 401. Here, the piezoelectric speaker may further include a connector 404, which is connected between the first electrode 401 and the signal wire 407 and transmits the voltage from the signal wire 407 to the first electrode 401.

FIGS. 5A through 5C illustrate a process of manufacturing the piezoelectric speaker according to the first exemplary embodiment of the present invention.

First, as illustrated in FIG. 5A, the first electrode 401 is formed on a predetermined region of the upper surface of the piezoelectric thin film 400 that is similar to a ceramic thin film, and the second electrode 402 is formed on the lower surface of the piezoelectric thin film 400. Thereby, a piezoelectric diaphragm 403 for converting an electrical signal into a physical acoustic vibration signal is formed.

The thinner the piezoelectric thin film 400, the higher its output sound pressure. However, in order to reduce sound distortion at the thin piezoelectric diaphragm, the thickness of the piezoelectric thin film 400 preferably ranges from about 10 mm to about 60 mm. Further, the piezoelectric thin film 400 preferably has a single layer formed of lead zirconate titanate (PZT), lead magnesium niobate-lead titanate (PMN-PT), polyvinylidene fluoride (PVDF), lead zinc niobate-lead titanate (PZN-PT), lead ytterbium niobate-lead titanate (PYN-PT), or lead indium niobate-lead titanate (PIN-PT).

The first and second electrodes 401 and 402 formed on the upper and lower surfaces of the piezoelectric thin film 400 can use gold (Au), silver (Ag), platinum (Pt), aluminum (Al), copper (Cu), or the like, and preferably have a thickness between 0.2 mm and 0.3 mm. The second electrode 402 is formed on the lower surface of the piezoelectric thin film 400, and the first electrode 401 is formed on the upper surface of the piezoelectric thin film 400, on the basis of an optimal design to able to obtain maximum displacement. The first electrode 401 preferably has the shape of an ellipse, the major and minor axes of which have length between 0.5 mm and 0.6 mm and between 0.48 mm and 0.5 mm, respectively.

The piezoelectric diaphragm 403 does not require a separate metal diaphragm as in the prior art, so that it can be formed by a simple process and obtain a high output sound pressure due to its thinness.

Next, as illustrated in FIG. 5B, a damping material layer 405 is coated under the second electrode 402. At this time, the damping material layer 405 is coated using spin coating or a micropipette according to thickness. The damping material layer 405 is preferably formed of a high-elasticity low-viscosity material in order to compensate for mechanical properties as well as to correct sound distortion that may occur at the piezoelectric diaphragm 403. Further, such a low-viscosity material makes it possible to obtain a very uniform coating layer, and thus to prevent unnecessary vibration and sound distortion, and is favorable for mass production because it facilitates a process.

Further, the damping material layer 405 preferably uses a material having low viscosity and a low Young's modulus, such as synthetic resin or rubber, which provides high absorption of the unnecessary vibration and high elasticity. In the first exemplary embodiment of the present invention, the damping material layer 405 is a low-viscosity damping material layer that allows a room-temperature process, provides a very uniform layer, and has high elasticity. Further, the piezoelectric thin film 400 having a high piezoelectric coefficient has a high Young's modulus. As such, if the damping material layer 405 having a relatively low Young's modulus becomes thick, the piezoelectric diaphragm 403 itself becomes heavy due to the thick damping material layer 405. Thus, the heavy piezoelectric diaphragm 403 is suitable for reproduction of low frequencies. Also, due to the heavy piezoelectric diaphragm 403, an initial resonance frequency becomes low, which results in reinforcement of low frequency characteristics. Here, the resonance frequency can be calculated by Equation 1 below:

$$f_{resonance} = \sqrt{\frac{k}{m_s}} \qquad \text{Equation 1}$$

where k is the spring constant, and $m_s$ is the mass of the thin film.

In this manner, the piezoelectric thin film 400 is used as the piezoelectric diaphragm 403, and simultaneously is coated with the high-elasticity damping material layer 405. As a result, sound distortion that may occur at the piezoelectric diaphragm 403 is remarkably improved. Further, the problem of conventional piezoelectric speaker as of reproducing low-frequency sound is solved. In other words, the gamut of tones is expanded to the low-frequency region to enable rich sound reproduction.

Continuing, as illustrated in FIG. 5C, the frame 409 is attached around the piezoelectric diaphragm 403, which is coated with the damping material layer 405, by applying an adhesive 408. Here, the adhesive 408 may be selected from low-viscosity high-elasticity adhesives such as high-elasticity epoxy adhesives, to serve as a filler absorbing vibration of the piezoelectric diaphragm 403.

Further, the frame 409 has a thickness of 1 mm or less, and is preferably formed of material capable of well absorbing the vibration of the piezoelectric diaphragm 403 without causing the piezoelectric diaphragm 403 to unnecessarily vibrate. Examples of this material include polybutylene terephthalate (PBT), polyacetal resin (also known as polyoxymethylene (POM) resin), polycarbonate (PC) resin, and so on, each of which must have high mechanical strength, good heat resistance and electrical insulation, high impact resistance, and a very small change in dimensions.

Finally, the first and second electrodes 401 and 402 of upper and lower portions of the piezoelectric diaphragm 430 are welded to terminals formed on the frame 409, and the piezoelectric materials are polarized. This completes manufacturing of the piezoelectric speaker.

Figure 6:
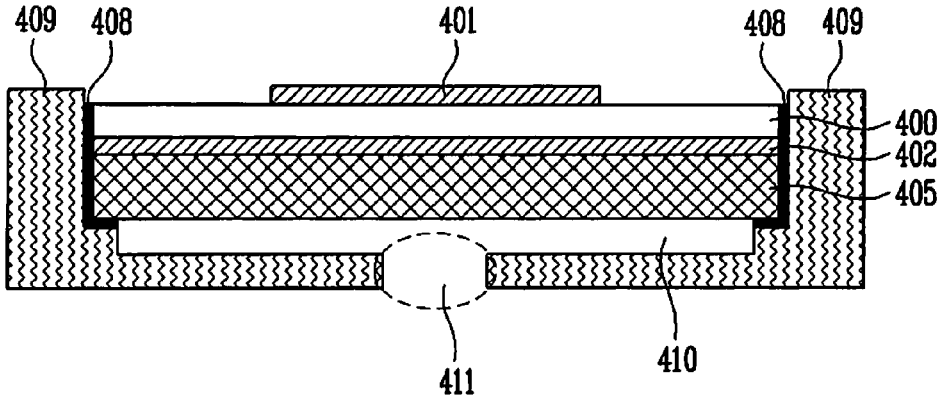
FIG. 6 is a cross-sectional view illustrating a piezoelectric speaker according to a second exemplary embodiment of the present invention.

FIG. 6 is a cross-sectional view illustrating a piezoelectric speaker according to a second exemplary embodiment of the present invention.

Figure 5:
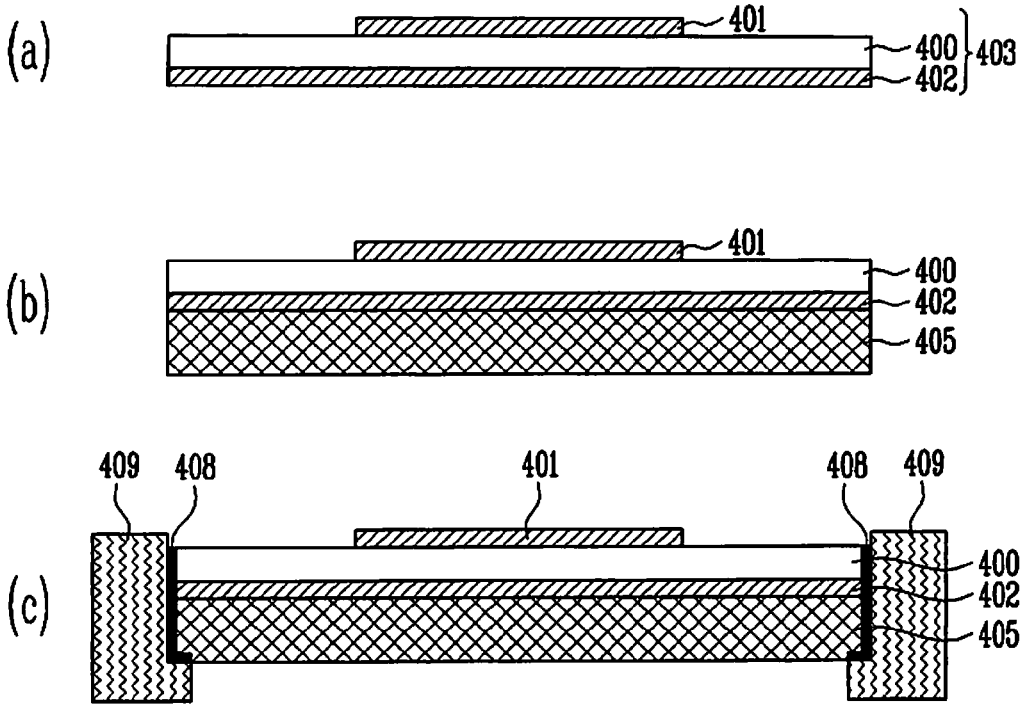
FIGS. 5A through 5C illustrate a process of manufacturing the piezoelectric speaker according to the first exemplary embodiment of the present invention.

The piezoelectric speaker according to the second exemplary embodiment is manufactured in the same way as illustrated in FIG. 5 except that a frame 409 is attached to left and right sides of a piezoelectric diaphragm 403 such that a rear acoustic chamber 410 is formed to damp the piezoelectric diaphragm 403.

Referring to FIG. 6, a damping material layer 405 is coated under the piezoelectric diaphragm 403 as in the processes of FIGS. 5A and 5B. Then, the frame 409 having a U-shaped cross-section, in the center of which an acoustic hole 411 is formed, is attached to the left and right sides of the piezoelectric diaphragm 403 using an adhesive 408.

Preferably, the frame 409 has a total thickness ranging from 1.5 mm to 2 mm, and the hall 411 of the center of the frame 409 has a diameter ranging from about 1 mm to about 2 mm to adjust damping. Up to now, the frame 409 having a U-shaped cross-section has been described as attached to the left and right sides of the piezoelectric diaphragm 403, because that is what is shown in the cross-sectional view of FIG. 6. In fact, the frame 409 having a U-shaped cross-section is attached around the piezoelectric diaphragm 403 such that the acoustic hole 411 is formed in the center of the frame 409 below the piezoelectric diaphragm 403.

The piezoelectric speaker formed in this way in accordance with the second exemplary embodiment has the rear acoustic chamber 410 of the piezoelectric diaphragm 403, serving not only to smooth the peak-dip typically occurring at the piezoelectric speaker, but also to correct the sound pressure so as to uniformly maintain sound pressure according to frequency.

Figure 7:
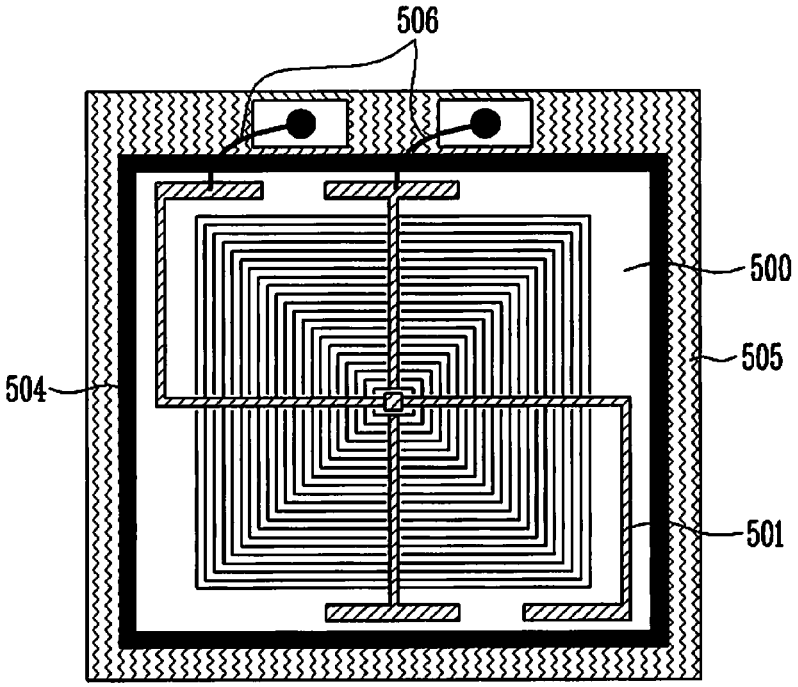
FIG. 7 is a plan view illustrating a piezoelectric speaker according to a third exemplary embodiment of the present invention.

FIG. 7 is a plan view illustrating a piezoelectric speaker according to a third exemplary embodiment of the present invention.

Referring to FIG. 7, the piezoelectric speaker according to the third exemplary embodiment includes a flat piezoelectric thin film 500, engaging electrodes 501 formed on an upper surface of the piezoelectric thin film 500 in a predetermined pattern, a frame 505 attached around the piezoelectric thin film 500 using an adhesive 504, and signal wires 506 formed on a predetermined region of the frame 505 to apply voltage to the engaging electrodes 501.

Figure 8:
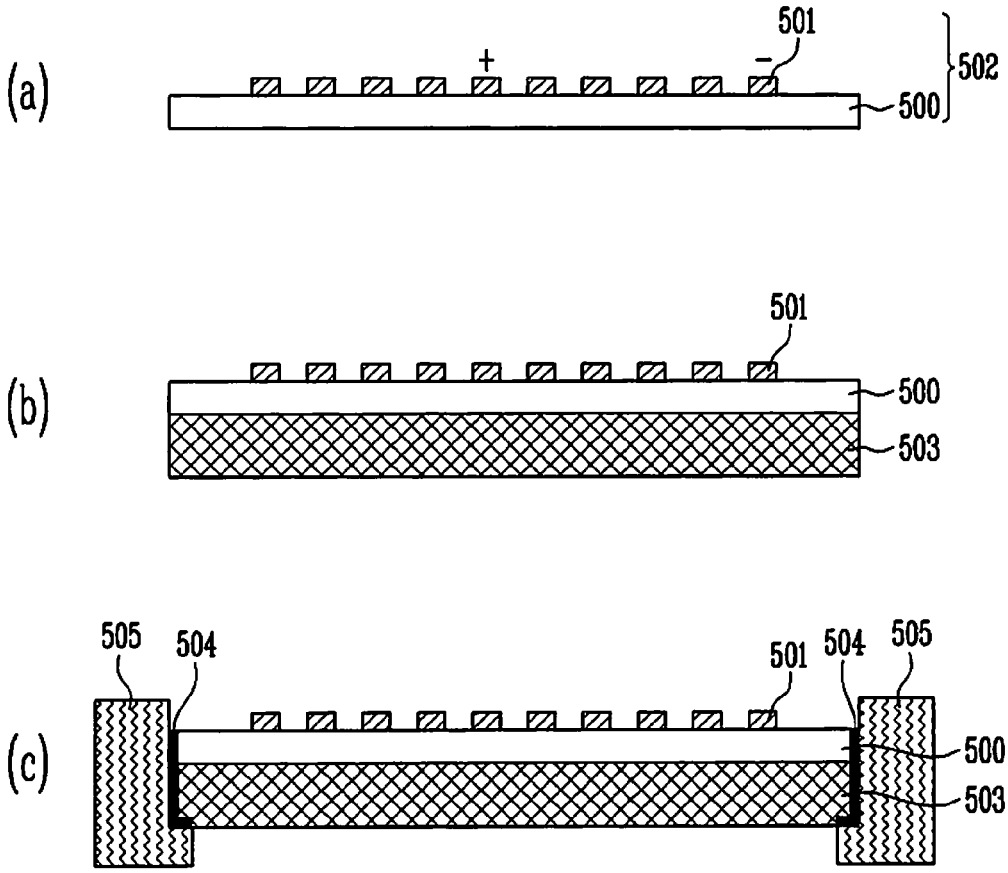
FIGS. 8A through 8C illustrate a process of manufacturing the piezoelectric speaker according to the third exemplary embodiment of the present invention.

FIGS. 8A through 8C illustrate a process of manufacturing the piezoelectric speaker according to the third exemplary embodiment of the present invention.

First, as illustrated in FIG. 8A, the engaging electrodes 501 are formed on the upper surface of the piezoelectric thin film 500 in a predetermined pattern, so that a piezoelectric diaphragm 502 is formed.

Since the engaging electrodes 501 are formed on the upper surface of the piezoelectric thin film 500, the piezoelectric thin film 500 vibrates along the engaging electrodes 501. This process makes it possible to use a lateral polarization mode of the piezoelectric thin film 500, and thus to obtain a high sound pressure. Further, this process can be equally applied to a micro-electro-mechanical system (MEMS) process suitable for a very thin micro-speaker.

Next, as illustrated in FIG. 8B, a damping material layer 503 is coated under the piezoelectric diaphragm 502 including the engaging electrodes 501 on the piezoelectric thin film 500. As illustrated in FIG. 8C, a frame 505 is attached around the piezoelectric diaphragm 502 by applying an epoxy-based adhesive 504 to left and right sides of the piezoelectric diaphragm 502 coated with the damping material layer 503.

In this manner, the piezoelectric thin film 500 is used as a diaphragm. This process makes a large area process possible, and can reduce manufacturing cost to become very favorable for mass production. In addition, this process makes it possible to miniaturize the piezoelectric speaker, to reduce a thickness to 1 mm or less, and to very easily apply the piezoelectric speaker to portable electronic devices such as mobile phones, personal digital assistants (PDAs), laptop computers, and so on.

Further, the design combining the damping material layer 503, the low-viscosity adhesive 504, and the frame 505 goes far to overcome problems of sound distortion and inability to reproduce low-frequency sound, from which a conventional piezoelectric speaker suffers. That is, it can reduce sound distortion at the thin diaphragm, greatly improve sound reproduction in a low-frequency region, and smooth out the output sound pressure.

Figure 9:
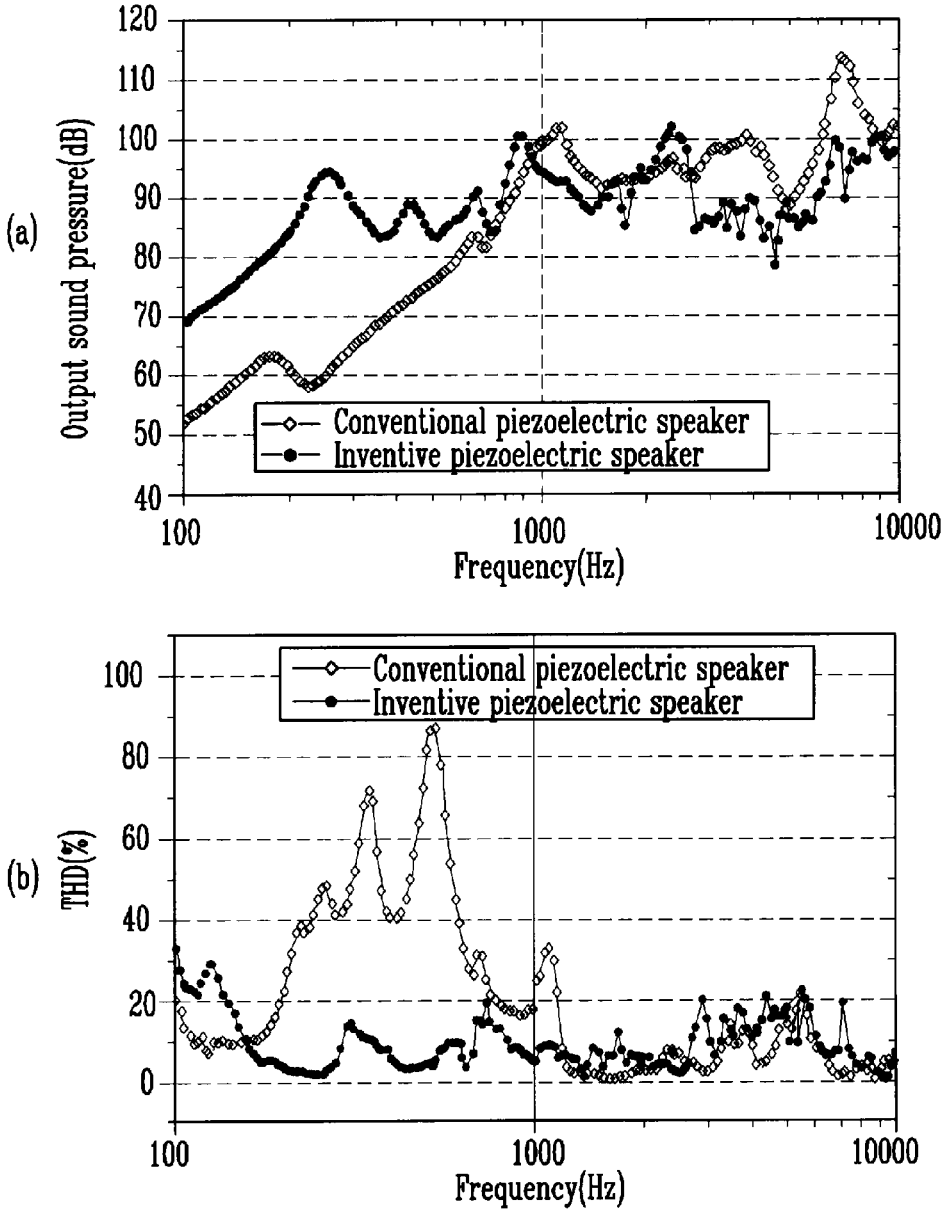
FIG. 9 shows graphs of results of evaluating characteristics of the piezoelectric speaker according to the first exemplary embodiment of the present invention.

FIG. 9 shows graphs of results of evaluating characteristics of the piezoelectric speaker according to the first exemplary embodiment of the present invention. More particularly, it shows graphs of results of comparing performance of the inventive piezoelectric speaker with that of a conventional commercial piezoelectric speaker.

In detail, FIG. 9A shows characteristics of output sound pressures of the inventive piezoelectric speaker and the conventional piezoelectric speaker with respect to frequency. It can be seen from FIG. 9A that the output sound pressure of the inventive piezoelectric speaker is smooth compared to that of the conventional piezoelectric speaker.

FIG. 9B shows results of measuring total harmonic distortion (THD), defined using Equation 2 below, versus frequency. It can be seen from FIG. 9B that the inventive piezoelectric speaker has a very low degree of sound distortion compared to the conventional piezoelectric speaker.

$$\% \ THD = 100 \times \sqrt{\frac{A_2^2 + A_3^2 + \ldots + A_N^2}{A_1^2 + A_2^2 + A_3^2 + \ldots + A_N^2}} \qquad \text{Equation 2}$$

where $A_N$ is the N-th harmonic distortion component.

Further, the inventive piezoelectric speaker is very thin, small, and has low power consumption compared to a conventional voice coil motor (VCM) speaker, so that it is suitable for a multi-channel speaker array. Particularly, when the inventive piezoelectric speaker is applied to directional speaker technology, i.e., speaker array technology, it can solve a problem of power consumption, which may be caused by a speaker array, and can help to realize directional services of portable electronic devices due to very small thickness and light weight. The inventive piezoelectric speaker is not only applicable to portable electronic devices, but has various other applications including electronic appliances such as televisions (TVs), liquid crystal display (LCD) monitors, etc., exhibitions such as in art galleries, museums, parks, etc., seats of long-distance vehicles such as airplanes, buses, etc., and electronic display boards for stores, markets, etc. Further, since directional services can be provided through a speaker array, the piezoelectric speaker can be suitably employed as an external portable speaker to reduce weight and enhance portability.

Figure 10:
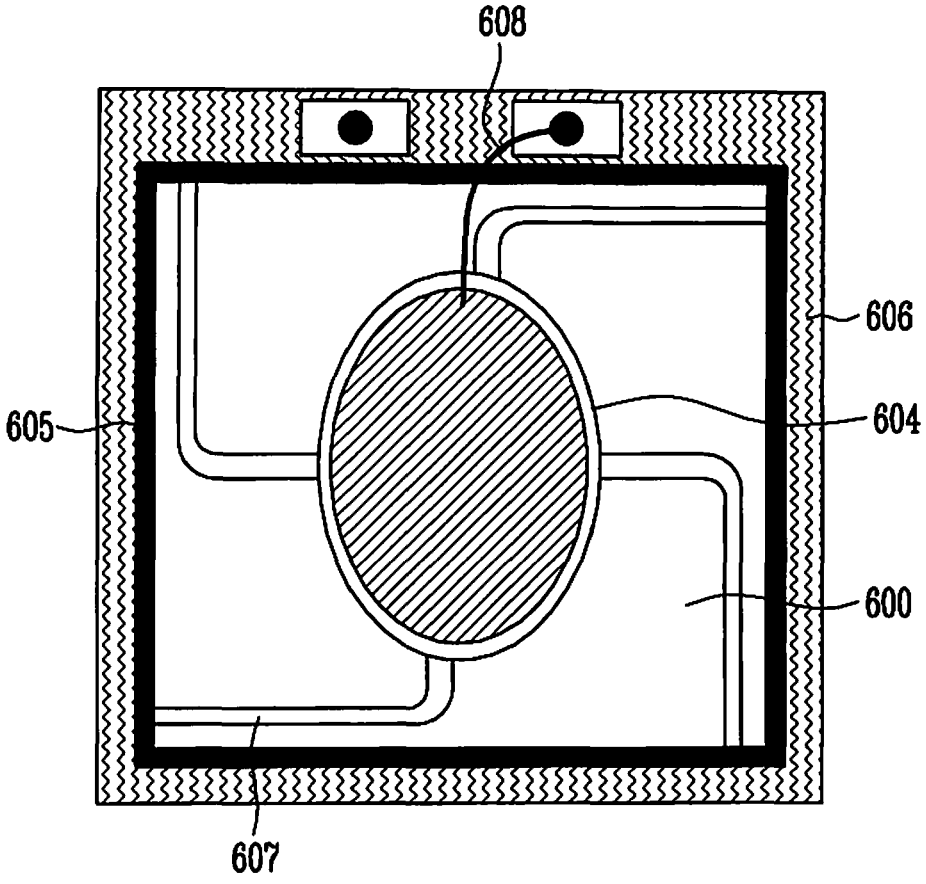
FIG. 10 is a plan view illustrating a piezoelectric speaker according to a fourth exemplary embodiment of the present invention.

FIG. 10 is a plan view illustrating a piezoelectric speaker according to a fourth exemplary embodiment of the present invention.

Referring to FIG. 10, the piezoelectric speaker according to the fourth exemplary embodiment includes a flat high-elasticity damping material layer 600 having grooves 607 etched in a predetermined pattern, a piezoelectric diaphragm 604 attached to the center of the damping material layer 600 where the grooves 607 are not formed in an elliptical shape, a frame 606 attached around the damping material layer 600 by applying an adhesive 605, and a signal wire 608 applying voltage to the piezoelectric diaphragm 604 formed on an upper surface of the damping material layer 600. Here, the piezoelectric diaphragm 604 includes a piezoelectric thin film on entire upper and lower surfaces of which electrodes are formed.

Figure 11:
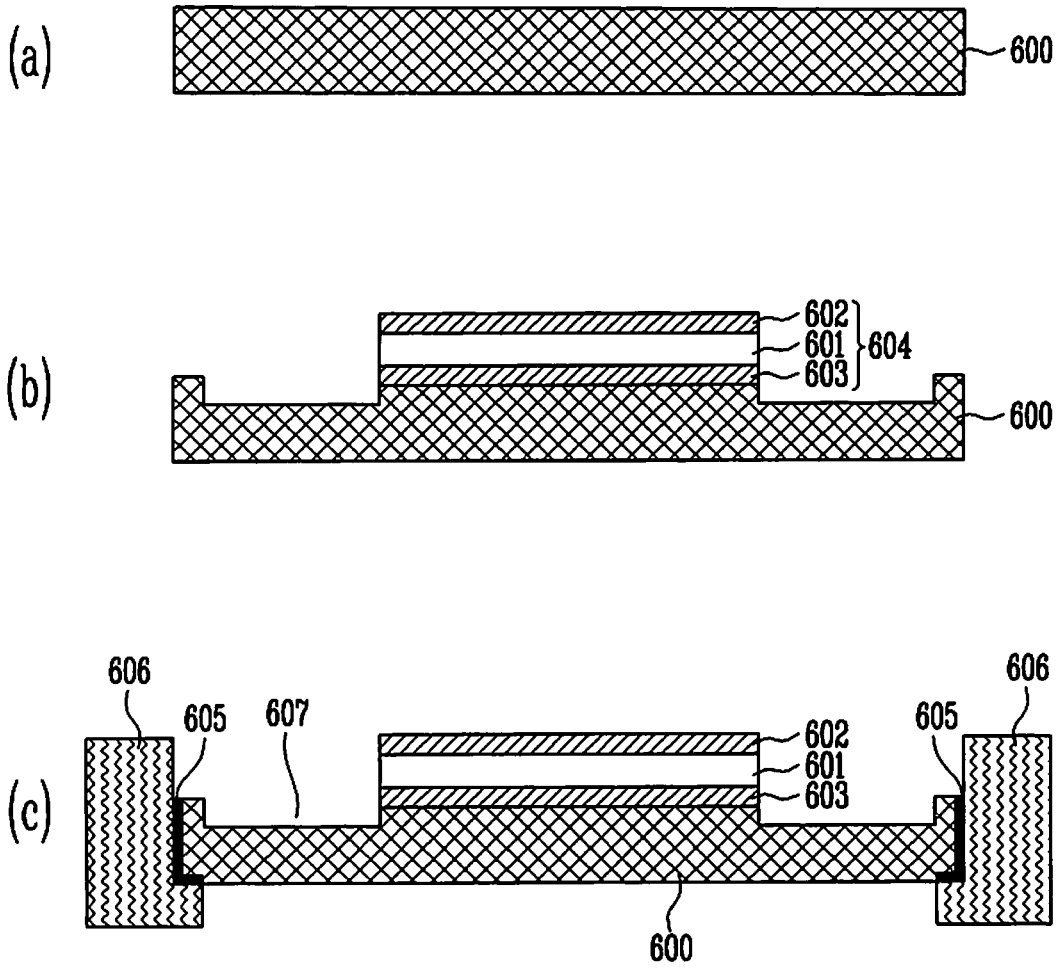
FIGS. 11A through 11C illustrate a process of manufacturing the piezoelectric speaker according to the fourth exemplary embodiment of the present invention.

FIGS. 11A through 11C illustrate a process of manufacturing the piezoelectric speaker according to the fourth exemplary embodiment of the present invention.

First, as illustrated in FIG. 11A, the flat damping material layer 600 for improving sound distortion that may occur at a thin diaphragm is uniformly etched into the upper surface thereof, particularly along an edge thereof, thereby forming grooves 607. Here, a pattern of the etched grooves 607 serves as a spring.

Next, as illustrated in FIG. 11B, the piezoelectric diaphragm 604 having first and second electrodes 602 and 603 on the entire upper and lower surfaces of a piezoelectric thin film 601 is attached to the center of the damping material layer 600 where the grooves 607 are not formed using an epoxy-based adhesive.

As illustrated in FIG. 11C, the frame 606 is attached around the piezoelectric diaphragm 604 by applying the adhesive 605 to the damping material layer 600, to which the piezoelectric diaphragm 604 is attached. This completes manufacturing of the piezoelectric speaker.

Here, the piezoelectric diaphragm 604 having the piezoelectric thin film 601 is attached to the upper surface of the damping material layer 600 having the patterned grooves 607, so that a high-elasticity thin film is used as a diaphragm. Thus, the diaphragm is made very flexible to increase output sound pressure.

Figure 12:
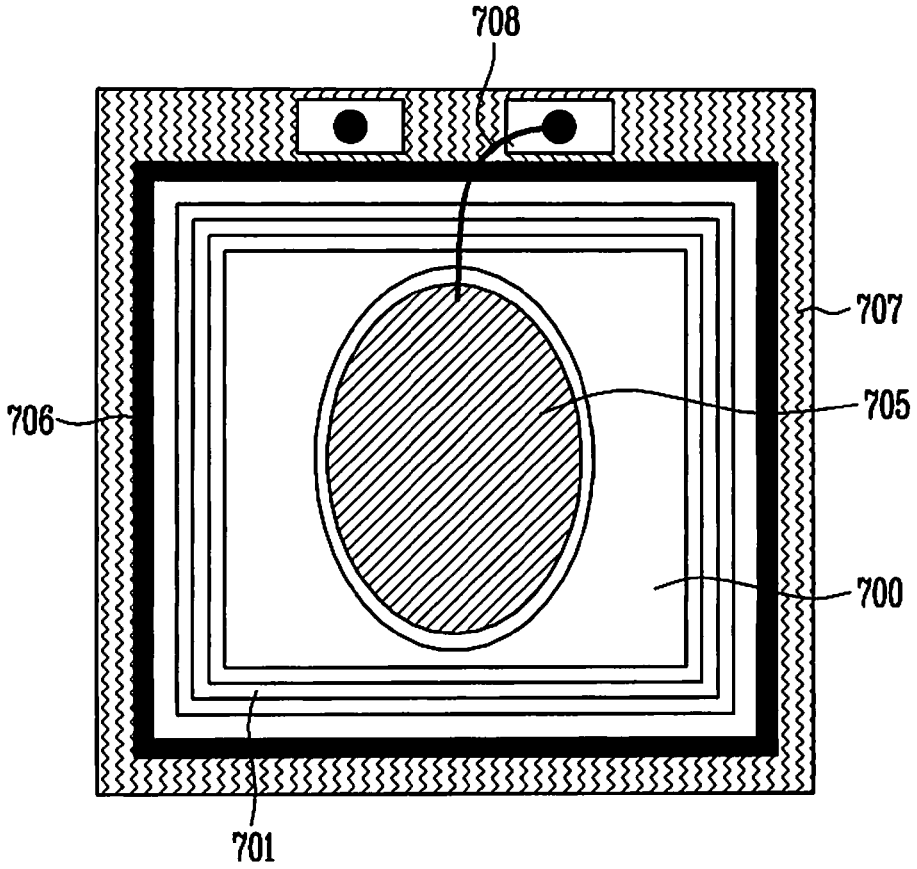
FIG. 12 is a plan view illustrating a piezoelectric speaker according to a fifth exemplary embodiment of the present invention.

FIG. 12 is a plan view illustrating a piezoelectric speaker according to a fifth exemplary embodiment of the present invention.

Referring to FIG. 12, the piezoelectric speaker according to the fifth exemplary embodiment includes a damping material layer 700 having a corrugated pattern 701 along an edge thereof, a piezoelectric diaphragm 705 formed on the center of the damping material layer 700 in an elliptical shape, a frame 707 attached around the damping material layer 700 by applying an adhesive 706, and a signal wire 708 formed on a predetermined region of the frame 707 and connected to an electrode included in the piezoelectric diaphragm 705 to apply voltage.

Figure 13:
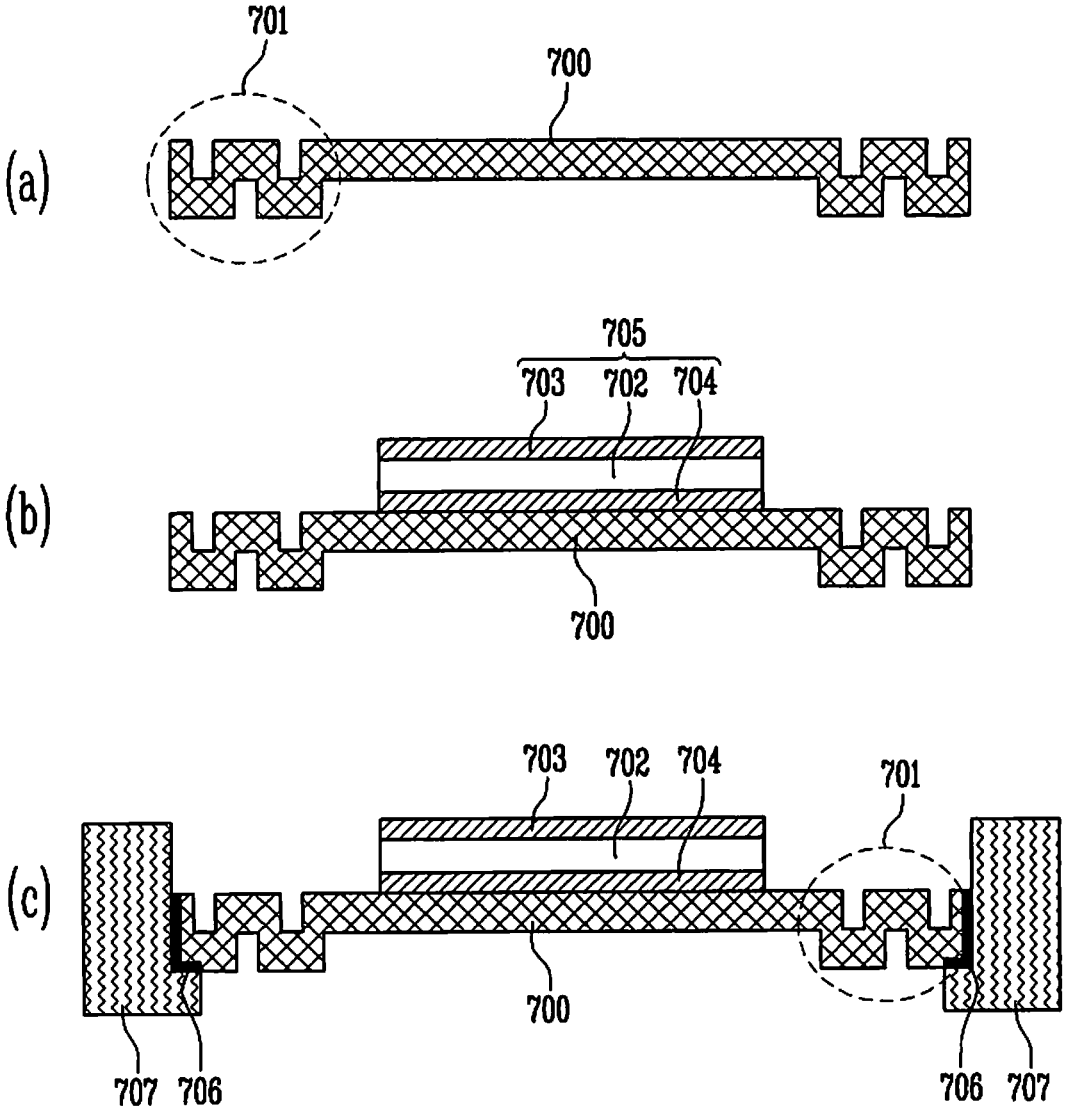
FIGS. 13A through 13C illustrate a process of manufacturing the piezoelectric speaker according to the fifth exemplary embodiment of the present invention.

FIGS. 13A through 13C illustrate a process of manufacturing the piezoelectric speaker according to the fifth exemplary embodiment of the present invention.

First, as illustrated in FIG. 13A, a damping material is injected into a mold, along an edge of which a corrugated pattern is formed. Thereby, the damping material layer 700 having the corrugated pattern 701 on the edge thereof is formed.

Then, as illustrated in FIG. 13B, the piezoelectric diaphragm 705, which has first and second electrodes 703 and 704 formed on upper and lower surfaces of a piezoelectric thin film 702, is attached to the center of the damping material layer 700 having the corrugated pattern 701 along the edge thereof using an epoxy-based adhesive. Subsequently, as illustrated in FIG. 13C, the frame 707 is attached around the damping material layer 700 using the adhesive 706 to surround the piezoelectric diaphragm 705. This completes manufacturing of the piezoelectric speaker.

According to this fifth exemplary embodiment, in the case in which the corrugated pattern 701 is formed along the edge of the damping material layer 700, a more flexible diaphragm can be formed to obtain a very high sound pressure, and sound reproduction in a low-frequency region can be improved as well due to excellent flexibility.

Figure 14:
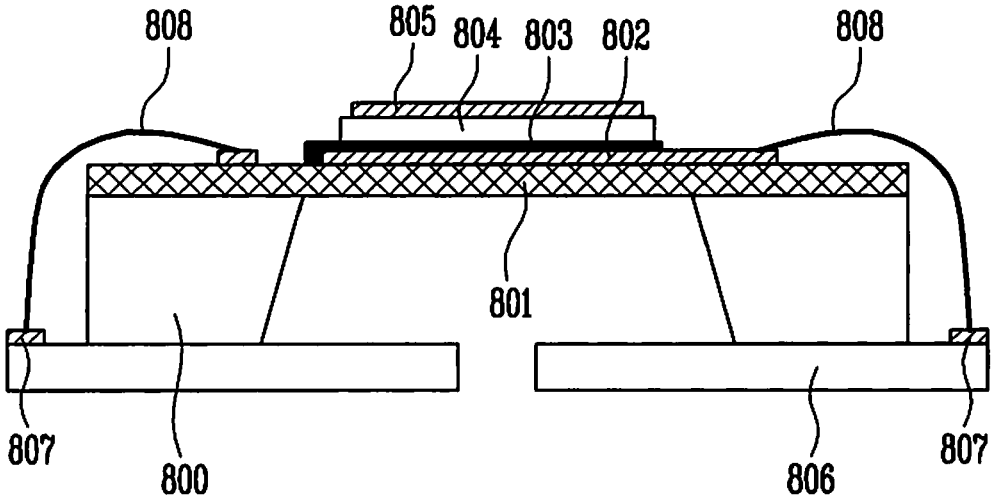
FIG. 14 is a cross-sectional view illustrating a piezoelectric speaker according to a sixth exemplary embodiment of the present invention.

FIG. 14 is a cross-sectional view illustrating a piezoelectric speaker according to a sixth exemplary embodiment of the present invention.

Referring to FIG. 14, the piezoelectric speaker according to the sixth exemplary embodiment is for manufacturing a micro speaker. To this end, a silicon substrate 800 is coated with a damping material layer 801 of a high-elasticity material such as rubber or synthetic resin, and a second electrode 802 is formed on a predetermined region of an upper surface of the damping material layer 801. Then, a piezoelectric thin film 804, on which a first electrode 805 is formed, is attached to an upper surface of the second electrode 802 using an epoxy-based adhesive 803. The silicon substrate 800 is etched from a lower surface thereof to the damping material layer 801, thereby forming a rear acoustic chamber. As a result, the silicon substrate 800 having the rear acoustic chamber serves as a piezoelectric diaphragm. Here, the rear acoustic chamber formed in the silicon substrate 800 has a quadrilateral or trapezoidal cross-section.

The piezoelectric diaphragm manufactured through this process is attached to a prepared frame 806, and then a third electrode 807 is formed on an edge of the frame 806, which is attached under the piezoelectric diaphragm. The third electrode 807 formed on the frame 806 is connected to the second electrode 802 formed on the damping material layer 801 by wire bonding using gold signal wires 808.

In this way, the micro speaker illustrated in FIG. 14 can be manufactured to a thickness of 0.5 mm or less, and to within about 2 mm including the frame 806.

Figure 15:
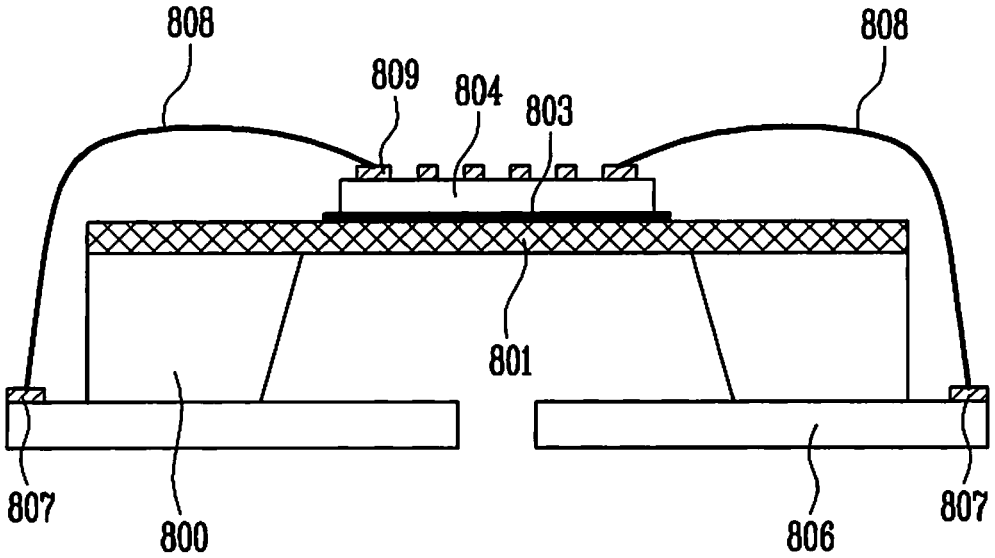
FIG. 15 is a cross-sectional view illustrating a piezoelectric speaker according to a seventh exemplary embodiment of the present invention.

FIG. 15 is a cross-sectional view illustrating a piezoelectric speaker according to a seventh exemplary embodiment of the present invention.

Referring to FIG. 15, the piezoelectric speaker according to the seventh exemplary embodiment is for manufacturing a micro speaker, and is manufactured by the process described with reference to FIG. 14, but it has a difference in that engaging electrodes 809 are formed on the upper surface of a piezoelectric thin film 804.

Briefly describing a process of manufacturing the piezoelectric speaker according to the seventh exemplary embodiment, a silicon substrate 800 is coated with a damping material layer 801, and a piezoelectric thin film 804 is attached to a predetermined region of an upper surface of the damping material layer 801 using an epoxy-based adhesive 803. Then, the engaging electrodes 809 are formed on the piezoelectric thin film 804.

Afterwards, a lower surface of the silicon substrate 800 is etched to form a rear acoustic chamber. As a result, the silicon substrate 800 having the rear acoustic chamber serves as a piezoelectric diaphragm. The piezoelectric diaphragm is attached to a prepared frame 806. A third electrode 807 formed on an edge of the upper surface of the frame 806 is connected to the engaging electrodes 809 by wire bonding using gold signal wires 808.

Consequently, the aforementioned exemplary embodiments use the piezoelectric thin film as the diaphragm, thus enabling a large area process and reducing manufacturing cost. The design combining the damping material layer and the frame can reduce sound distortion, greatly improve sound reproduction in a low-frequency region, and smooth out the output sound pressure.

The drawings and specification disclose typical exemplary embodiments of the invention and, although specific terms are employed, they are used in a generic and descriptive sense only and not for purposes of limitation. The scope of the invention is set forth in the following claims. Therefore, it will be understood by those of ordinary skill in the art that various changes in form and details may be made to the described embodiments without departing from the spirit and scope of the present invention as defined by the following claims.

What is claimed is:

1. A piezoelectric speaker, comprising:

a piezoelectric thin film;

an upper electrode disposed on an upper surface of the piezoelectric thin film;

a damping material layer configured to reinforce output sound pressure in a frequency region between 100 Hz and 1 kHz and formed over the lower surface of the piezoelectric thin film; and a frame attached to at least two side surfaces of the damping material layer using an adhesive.

2. The piezoelectric speaker of claim 1, wherein the upper electrode includes engaging electrodes configured to laterally polarize the piezoelectric thin film.

3. The piezoelectric speaker of claim 1, further comprising a lower electrode formed on the lower surface of the piezoelectric thin film, wherein the upper electrode is asymmetric to the lower electrode.

4. The piezoelectric speaker of claim 1, wherein the damping material layer is formed of a low-viscosity high-elasticity material.

5. The piezoelectric speaker of claim 1, wherein the adhesive is a high-elasticity epoxy resin.

6. The piezoelectric speaker of claim 1, wherein the frame is spaced apart from the lower surface of the piezoelectric thin film such that a rear acoustic chamber is formed below the piezoelectric thin film, and includes at least one acoustic hole in a lower portion thereof.

7. The piezoelectric speaker of claim 1, wherein edge portions of the damping material layer extend beyond outer edges of the piezoelectric thin film, and the edge portions of the damping material layer include a plurality of grooves in a predetermined pattern.

8. The piezoelectric speaker of claim 7, wherein the predetermined pattern is a corrugated pattern.

9. The piezoelectric speaker of claim 1, wherein the frame is formed of any one of polybutylene terephthalate (PBT), polyoxymethylene (POM), and polycarbonate (PC).

10. A method of manufacturing a piezoelectric speaker, comprising:

forming an upper electrode on an upper surface of a piezoelectric thin film;

forming a damping material layer on the lower surface of the piezoelectric thin film, wherein the damping material layer is configured to reinforce output sound pressure in a frequency region between 100 Hz and 1 kHz; and attaching a frame to at least two side surfaces of the damping material layer using an adhesive.

11. The method of claim 10, wherein the upper electrode includes engaging electrodes configured to laterally polarize the piezoelectric thin film.

12. The method of claim 10, further comprising forming a lower electrode on the lower surface of the piezoelectric thin film, wherein the upper electrode is asymmetric to the lower electrode.

13. The method of claim 10, wherein edge portions of the damping material layer extend beyond outer edges of the piezoelectric thin film, and the edge portions of the damping material layer include a plurality of grooves in a predetermined pattern.

14. The method of claim 13, wherein the predetermined pattern is a corrugated pattern.

15. The method of claim 10, further comprising forming at least one hole in a lower portion of the frame.

16. A method of manufacturing a piezoelectric speaker, comprising:

forming a damping material layer on a silicon substrate, wherein the damping material layer is configured to reinforce output sound pressure in a frequency region between 100 Hz and 1 kHz;

attaching a piezoelectric thin film, on which a first electrode is formed, to an upper surface of the damping material layer; and attaching a frame to at least two side surfaces of the damping material layer using an adhesive.

17. The method of claim 16, further comprising forming a second electrode on the upper surface of the damping material layer, before the piezoelectric thin film is attached to the upper surface of the damping material layer.

18. The method of claim 16, further comprising partially etching the silicon substrate to form a rear acoustic chamber.

19. The method of claim 17, further comprising:

forming a third electrode on the frame; and connecting the first electrode or the first and second electrodes to the third electrode through wire bonding.

* * * * *